US007389730B2

(12) United States Patent
Reuter

(10) Patent No.: US 7,389,730 B2
(45) Date of Patent: Jun. 24, 2008

(54) TRACK-GUIDED TOY VEHICLE

(75) Inventor: Uwe Reuter, Althengstett (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 202 days.

(21) Appl. No.: 11/335,614

(22) Filed: Jan. 20, 2006

(65) Prior Publication Data

US 2006/0169168 A1 Aug. 3, 2006

(30) Foreign Application Priority Data

Jan. 20, 2005 (DE) ..... 10 2005 002 612

(51) Int. Cl.
*B61C 11/00* (2006.01)

(52) U.S. Cl. ..... 105/77; 104/305; 446/446; 105/73; 105/76; 105/1.5

(58) Field of Classification Search ..... 105/30, 105/73, 76, 77, 78, 1.5, 29.2, 157.2; 104/242, 104/53, 60, 305, DIG. 1; 180/65.6; 188/165; 335/302; 446/129, 130, 446, 455, 131, 133, 446/447, 448

See application file for complete search history.

(56) References Cited

U.S. PATENT DOCUMENTS 1,869,199 A 7/1932 Koerber
2,046,310 A * 7/1936 Billner ..... 104/242
4,031,661 A 6/1977 Bernhard
4,221,077 A 9/1980 von Winckelmann
5,896,017 A 4/1999 Severson et al.
6,422,151 B2 * 7/2002 Maleika ..... 104/53

FOREIGN PATENT DOCUMENTS

DE 3240712 C2 5/1984
WO WO 02/068077 A1 9/2002

OTHER PUBLICATIONS

European Search Report dated May 10, 2006 including an English translation of pertinent portion (Nine (9) pages).

* cited by examiner

*Primary Examiner*—Mark Le
(74) *Attorney, Agent, or Firm*—Crowell & Moring LLP

(57) ABSTRACT

A toy vehicle is operated as a track-guided vehicle and cooperates with a metallic current rail device of the track via one or more current consumers. A magnet is installed in the toy vehicle which is moved by an electric motor to optimize the traction between the track and the toy vehicle. This magnet is directed at the current rail device of the track. The magnet's magnetic force can be influenced as a function of driving operation states of the toy vehicle driven by the electric motor.

10 Claims, 1 Drawing Sheet

TRACK-GUIDED TOY VEHICLE

CROSS-REFERENCE TO RELATED APPLICATIONS

This application is related to U.S. application Ser. No. 11/335,611 (Our Ref. No. 028987.57318US) filed in Jan. 20, 2006, based on German Application No. 10 2005 002 882.9 filed in Germany on Jan. 21, 2005 and to U.S. application Ser. No. 11/335,576 (Our Ref. No. 028987.57319US) filed on Jan. 20, 2006, based on German Application No. 10 2005 002 883.7 filed on Jan. 21, 2005.

BACKGROUND AND SUMMARY OF THE INVENTION

The invention relates to a track-guided toy vehicle operated as a track-guided vehicle on a raceway cooperating via a current consumer with a metallic current rail device of the raceway, whereby a magnet is installed in the toy vehicle which is moved by an electric motor, to optimize the traction between the track and the toy vehicle, said magnet being directed at the current rail device of the track.

A known toy vehicle shown in DE 32 40 712 C2 is driven by an electric motor on a track having a guide groove for a guide pin on the toy vehicle, with the guide groove containing a ferromagnetic current conductor. A permanent magnet is installed in the vehicle to improve the traction of the toy vehicle by magnetic cohesion.

U.S. Pat. No. 3,690,393 describes a toy vehicle suitable for operation on a magnetic track. The wheels of the toy vehicle there are magnets because that targeted traction between said wheels and the raceway is the desired goal.

An object of the present invention is to provide a toy vehicle that can be operated on a track with the aid of a magnet such a that a properly functioning traction of the toy vehicle is ensured under different driving operation states.

This object has been achieved by providing that the magnetic force of the traction-optimizing magnet is influencable as a function or condition of the driving states of the toy vehicle.

Among the main advantages achieved with the present invention are that the controlled magnetic force of the magnet provides the toy vehicle with excellent traction in defined driving operation states. When driving straight ahead, the toy vehicle achieves a higher speed, because the magnetic force decreases with an increase in speed. The force may be zero at full load. In the braking position of a regulator with which the toy vehicle is controlled, the toy vehicle is pulled toward the track under the influence of magnetic force and the braking distance is shortened by increasing the rolling resistance and the magnetic force. The magnetic force stabilizes the vehicle in turning, namely when the person controlling the vehicle briefly moves the regulator in the direction of zero. In addition, when turning the vehicle, the drift angle and thus also the curve stability can be metered in a controlled manner via the position of the regulator. Finally, the structural design of the magnet and its arrangement in the toy vehicle can be implemented with comparatively simple means.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
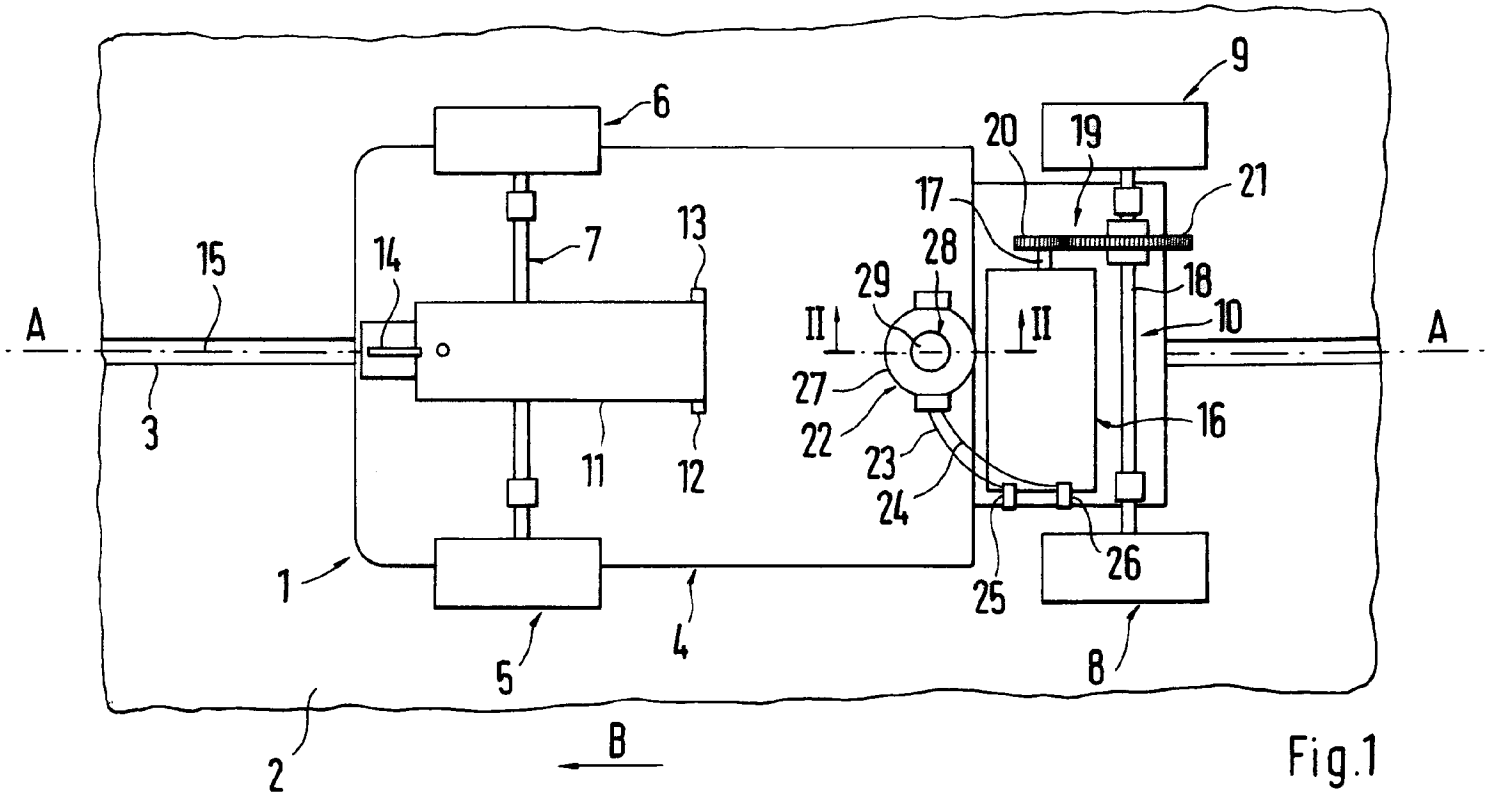
FIG. 1 is a schematic top plan view of the toy vehicle with a magnet of the present invention.

A toy vehicle 1 is constructed for track-guided operation on a track 2 comprised of one or more sections of track and having a metal current rail mechanism 3. A chassis 4 of the toy vehicle 1 is provided with a front axle 7 having front wheels 5, 6 and a rear axle 10 having rear wheels 8, 9. A rocker arm 11 in the area of the front axle 7 is mounted to rotate about the bearing pins 12, 13 and is provided with a wedge-like guide element 14. The guide element 14 is arranged to extend along a central longitudinal plane A-A of the toy vehicle 1 and engages in a groove 15 in the track 2 in the area of the current rail mechanism 3.

An electric motor 16 is used to drive the toy vehicle 1. The motor 16 is aligned with a drive shaft 17 across the central longitudinal plane A-A and is installed in the chassis 4 between the front axle 7 and the rear axle 10 but adjacent to the latter. A gear designated generally by numeral 19 operates between the drive shaft 17 of the electric motor 16 and an axle shaft 18 of the rear axle 10, and includes two gearwheels 20, 21. The electric motor 16 is connected to the rocker arm 11 and receives its operating current via conventional current consumers (not shown) that are in contact with the current rail mechanism 3.

Figure 2:
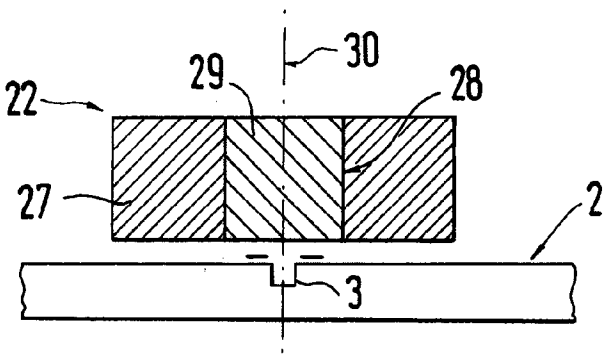
FIG. 2 is a sectional view along line II-II in FIG. 1.

A magnet 22 whose magnetic force can be influenced as a function of driving operation states, e.g. driving straight ahead, braking, turning, of the toy vehicle 1 is installed in the chassis 4. To this end, the magnet 22 is driven by the operating current of the electric motor 16, and the magnet 22 is connected to the electric motor 16, which is mounted on the chassis 4 with mounting devices 25 and 26, with the help of electric conductors 23, 24. As seen in FIG. 2, the magnet 22 is constructed in a circular as a cylinder shape and includes a ring-shaped permanent magnet 27 with a borehole 28 into which a disconnect coil 29 is inserted. A central axis 30 of the magnet 22 is aligned or intersects approximately at the central longitudinal plane A-A. The position of the central axis 30 on the central longitudinal plane A-A is relatively close to the electric motor 16 in the illustrated embodiment. However, the central axis 30 may also be arranged farther forward in the toy vehicle travel direction, its optimal position being ascertainable empirically and/or by calculations.

When the operating current of the electric motor 16 is applied to the disconnect coils 29, a magnetic field directed in the direction opposite the effective direction of the permanent magnet 27 is generated and consequently the resulting total magnetic field reduced and/or canceled. This is accomplished by the operating current supplied via the current-consumers of the disconnect coil 27 of the magnet 22. The operating current, which acts in proportion to the driving speed, is controlled by the person controlling the toy vehicle 1 by way of a known-type manually operable regulator.

The following driving operation states occur during operation of the toy vehicle:

- When driving straight ahead, braking straight ahead and turning a corner, different pressing or traction forces are generated via the magnet 22.
- The magnet 22 generates little or no pressing force or traction when driving straight ahead but generates a high pressing or traction force during braking operations and when turning a corner.
- The magnet generates a high pressing or traction force when turning a corner with a large radius and generates a high but controllable pressing or traction force when turning a corner with a small radius.

To be able to define the pressing or traction forces of the magnet 22 as a function of the various driving operation states, calculation conventional methods or empirical methods are used.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

I claim:

1. Toy vehicle operated as an electric-motor movable, track-guided vehicle on a raceway cooperating via a current consumer with a metallic current rail device of the raceway, a magnet comprised of a cylinder having a ring-shaped permanent magnet and a disconnect coil inserted into a borehole in the permanent magnet, and operatively provided in the vehicle to optimize the traction between the track and the toy vehicle, said magnet being directed at the current rail device of the track, wherein the magnetic force of the magnet is configured to be influencable as a function of driving operation states of the electric motor driven toy vehicle.

2. Toy vehicle as recited in claim 1, wherein the magnet is configured to be controlled by operating current of an electric motor used to drive the toy vehicle.

3. Toy vehicle as recited in claim 2, wherein the magnet is operatively connected to the electric motor by electric lines.

4. Toy vehicle as recited in claim 1 wherein the magnet is arranged adjacent to an electric motor driving a rear axle of the toy vehicle.

5. Toy vehicle as recited in claim 4, wherein the magnet is configured to be controlled by operating current of an electric motor used to drive the toy vehicle.

6. Toy vehicle as recited in claim 5, wherein the magnet is operatively connected to the electric motor by electric lines.

7. Toy vehicle as recited in claim 1, wherein a central axis of the cylinder is situated approximately on a central longitudinal plane of the toy vehicle.

8. Method for operating the magnet installed in the toy vehicle of claim 1, comprising generating different pressing forces via the magnet when the toy vehicle is driving straight ahead, when braking while driving straight ahead and when turning a corner.

9. Method as recited in claim 8, wherein the magnet generates little or no pressing force when driving straight ahead but generates a high pressing force during braking operations and when turning a corner.

10. Method as recited in claim 8, characterized in that the magnet generates a high pressing force when turning a corner with a large radius and generates a high but controllable pressing force when turning a corner with a small radius.

* * * * *